US009181823B2

(12) United States Patent
Melchior

(10) Patent No.: US 9,181,823 B2
(45) Date of Patent: Nov. 10, 2015

(54) DEVICE FOR THE VARIABLE CONTROL OF AT LEAST ONE VALVE, FOR EXAMPLE FOR A RECIPROCATING ENGINE

(71) Applicant: Jean Frederic Melchior, Paris (FR)

(72) Inventor: Jean Frederic Melchior, Paris (FR)

( * ) Notice: Subject to any disclaimer, the term of this patent is extended or adjusted under 35 U.S.C. 154(b) by 0 days.

(21) Appl. No.: 14/375,559

(22) PCT Filed: Jan. 30, 2013

(86) PCT No.: PCT/FR2013/050188

§ 371 (c)(1),
(2) Date: Jul. 30, 2014

(87) PCT Pub. No.: WO2013/114041

PCT Pub. Date: Aug. 8, 2013

(65) Prior Publication Data

US 2015/0013630 A1 Jan. 15, 2015

Related U.S. Application Data

(60) Provisional application No. 61/594,069, filed on Feb. 2, 2012.

(30) Foreign Application Priority Data

Feb. 2, 2012 (FR) ..... 12 50963

(51) Int. Cl.

| | |
|---|---|
| ***F01L 9/02*** | (2006.01) |
| ***F01L 1/46*** | (2006.01) |
| ***F01L 1/047*** | (2006.01) |
| ***F01L 1/26*** | (2006.01) |

(Continued)

(52) U.S. Cl.

CPC ..... *F01L 1/462* (2013.01); *F01L 1/047* (2013.01); *F01L 1/26* (2013.01); *F01L 1/267* (2013.01); *F01L 9/02* (2013.01); *F01L 9/021* (2013.01);

(Continued)

(58) Field of Classification Search

CPC ..... F01L 1/462; F01L 9/02; F01L 9/021; F01L 9/023; F01L 13/0005; F01L 13/0047; F01L 2001/34446

USPC ..... 123/90.12, 90.13, 90.65

See application file for complete search history.

(56) References Cited

U.S. PATENT DOCUMENTS 7,434,556 B2 * 10/2008 Harmon ..... 123/90.44

FOREIGN PATENT DOCUMENTS

| | | | |
|---|---|---|---|
| EP | 1375843 A1 | 1/2004 | ..... F01L 9/02 |
| EP | 2204566 a1 | 7/2010 | ..... F05D 41/14 |

(Continued)

OTHER PUBLICATIONS

International Search Report from corresponding WIPO Publication No. WO 2013/114041A1 dated Apr. 2, 2013, 3 pages.

*Primary Examiner* — Ching Chang
(74) *Attorney, Agent, or Firm* — Kusner & Jaffe

(57) ABSTRACT

A device for controlling at least one valve, the device comprising a body having a non-deformable cavity communicating exclusively with the outside via at least four rectilinear cylinders that are closed respectively by an opening piston (P1) actuated by an opening cam (C1), a closing piston (P2) actuated by a closing cam (C2), a shuttle piston (Pa) serving to load or unload the device, and a piston (Ps) that is mechanically connected to the valve. By adjusting the angular phase shift between the opening and closing cams (C1, C2), the control device of the invention makes it possible in operation to adjust the lift of the valve, the angular duration of the opening of the valve, and if necessary, to deactivate the valve completely throughout the duration of a cycle.

15 Claims, 8 Drawing Sheets

(51) Int. Cl.
*F01L 13/00* (2006.01)
*F01L 1/344* (2006.01)

(52) U.S. Cl.
CPC ..... *F01L 9/023* (2013.01); *F01L 13/0005* (2013.01); *F01L 13/0047* (2013.01); *F01L 2001/0473* (2013.01); *F01L 2001/34446* (2013.01)

(56) References Cited

FOREIGN PATENT DOCUMENTS

| | | | | |
|---|---|---|---|---|
| GB | 313231 | A | 7/1929 | |
| WO | WO 01/21939 | A2 | 3/2001 | ..... F01L 9/02 |
| WO | WO 02/48510 | A2 | 6/2002 | |

* cited by examiner

DEVICE FOR THE VARIABLE CONTROL OF AT LEAST ONE VALVE, FOR EXAMPLE FOR A RECIPROCATING ENGINE

FIELD OF THE INVENTION

The present invention relates in general to a device for controlling at least one valve, e.g. for a reciprocating engine, and more particularly it relates to a variable control device for controlling at least one valve that is actuated by at least two cams carried by shafts that are synchronous and angularly phase-shiftable relative to each other. The invention applies in particular to varying the timing of the valves of a reciprocating engine while it is in operation, the cylinder head of the engine carrying two coaxial cam shafts that are connected together by a phase shifter, e.g. a hydraulic phase shifter.

BACKGROUND OF THE INVENTION

The term "timing" is used in conventional manner to designate all of the opening and closing sequences of the valves of the engine.

It is known both that the performance of a reciprocating engine is highly dependent on the angular positions of the crank shaft at which the valves open and close during the cycle of the engine, and also that the optimum timing diagram changes with changing operating conditions, in particular with changing speed and changing load. Timing has an influence on the actual compression and expansion ratios (Miller cycles), on the quantity of exhaust gas that is optionally recycled, on the energy available from the exhaust gas, on the delivery ratio, on mechanical friction, etc. It is therefore desirable, while the engine is in operation, to be able to modify independently the angular positions of the crank shafts at which the intake and exhaust valves open and close.

In addition, the lift of intake valves strongly influences the turbulence in the combustion chamber, and it may be advantageous to adjust the power of a controlled ignition engine by throttling the admission stream via the intake valve seats rather than by means of a butterfly valve arranged upstream from an admission manifold.

Finally, it may be advantageous to deactivate certain cylinders of an engine by keeping their intake valves and/or their exhaust valves closed during certain stages of operation of the engine.

When the valves are actuated by cam shafts, said valves are pressed by return springs via alternating or sliding mechanisms against rotary cams of profiles that determine the motions in reciprocating translation of said valves. In order to avoid impacts, contact must never be lost between the elements in the drive train that connects together the cams and the valves, and also the valves must land on their seats at a speed that is practically zero.

Most variable devices that have been used in the past generate movement of a valve by using the profile of a single cam that is deformed mechanically or hydraulically.

The complexity of prior art devices for mechanically varying the duration and the lift of valve events (such as the "Valvetronic" device that constitutes the subject matter in particular of patent EP 1 039 103 in the name of BMW) requires very accurate machining, thereby making such devices relatively expensive.

Electrohydraulic devices (such as the "Uniair" device described in particular in patents EP 0 803 642 and EP 1 344 900 in the name of C.R.F.) present the drawback of losing all or some of the energy accumulated in the return springs and of depending largely on the viscosity of the lubricating oil.

Other devices generate valve movement from the profiles of two cams that can be phase-shifted relative to each other, the cams generally being carried by two coaxial shafts, one of which serves to open the valve and the other to close it.

Patent application WO 02/48510 in the name of the Applicant teaches hydraulically mixing the profiles of two phase-shiftable cams in order to modulate the duration of opening, with the drawback of presenting a minimum threshold for valve lift that makes it impossible to reduce the permeability of the orifice controlled by the valve in progressive manner down to total closure thereof.

The present invention relies on the same principle and seeks to provide the same functions as the best prior art devices, by implementing a single rotary phase shifter between two synchronous cam shafts.

The main object of the present invention is thus to be able to act, while in operation, to adjust the angular duration of the opening of at least one valve and also the lift of the valve all the way down to total closure, without losing the energy accumulated in the return means of the device as a result of a hydraulic fluid being throttled.

SUMMARY OF THE INVENTION

The present invention provides a control device for controlling at least one valve, e.g. for a reciprocating engine, the valve being driven with reciprocating motion in rectilinear translation to open or close an orifice having a sealing seat, said valve including resilient return means urging it towards a closed position, said device comprising a body including a non-deformable cavity communicating exclusively with the outside via at least four rectilinear cylinders that are closed respectively by four pistons, each of which is movable in reciprocating motion between a respective bottom dead-center remote from the inside of the cavity and a top dead-center close to the inside of the cavity, the device being characterized in that said pistons comprise a piston mechanically connected to the valve and working against its return means, an opening piston actuated by an opening cam that is driven in rotation by a first shaft, a closing piston actuated by a closing cam that is driven in rotation by a second shaft that rotates synchronously with the first shaft and that may be offset in operation relative to the first shaft through an adjustable angle, and a shuttle piston movable between a first stationary abutment defining its bottom dead-center and a second stationary abutment defining its top dead-center, the shuttle piston being urged towards its top dead-center by resilient means, in that the portion of the cavity that extends between the pistons is filled with a constant reference volume of substantially incompressible hydraulic fluid that is defined when the valve rests against its seat, when the opening and closing pistons are at their bottom dead-centers, and when the shuttle piston is at its top dead-center, in that the opening piston, the closing piston, and the shuttle piston have a common cylinder capacity and move the same volume of fluid between their bottom and top dead-centers, and in that the resilient return means of the shuttle piston and of the valve are such that the fluid pressure needed for moving the shuttle piston to its bottom dead-center is less than the pressure needed for opening the valve.

In the device in accordance with the invention, a working cycle corresponding to opening and closing the valve takes place over one complete revolution of the synchronous shafts that drive the opening and closing cams of the valve. The cycle begins and ends in a rest configuration of the device that defines the reference volume of the hydraulic fluid present in the cavity. In the rest configuration, the valve is urged against its seat by resilient means, the valve piston Ps is at its top dead-center, the shuttle piston Pa is urged against its second abutment by the corresponding resilient means and is at its top dead-center, and the opening and closing pistons P1 and P2 are at their bottom dead-centers, which dead-centers are defined by the base circles of the opening and closing cams C1 and C2.

During rotation of the shafts, the positions of the opening and closing pistons P1 and P2 depend solely on the angular positions of the cams C1 and C2, in accordance with their respective profiles. A crank shaft driving the cams can thus control the instantaneous positive or negative flow of fluid delivered into the cavity by the pistons P1 and P2, and can consequently control the instantaneous overall flow feeding the cavity, which flow is equal to the algebraic sum of the instantaneous flows delivered by the pistons P1 and P2. Since the pistons P1 and P2 are located simultaneously at their bottom dead-centers at the beginning of a cycle, the total volume delivered into the cavity by the pistons P1 and P2 from the beginning of the cycle lies at all times in the range zero to twice the common cylinder capacity of the pistons P1, P2, and Pa throughout the duration of the cycle. Since the reference volume of hydraulic fluid present in the cavity remains constant, the total volume delivered by the pistons P1 and P2 from their bottom dead-centers must be absorbed by the pistons Pa and Ps that are to be found at their top dead-centers at the beginning of the cycle. Given the ratings of their respective return means, the total delivered flow is at first absorbed solely by the shuttle piston Pa so long as said flow remains less than the above-mentioned common cylinder capacity. The piston Ps therefore can absorb only the delivered flow that exceeds said common cylinder capacity, which excess cannot be absorbed by the shuttle piston Pa, and can do so only once said piston has reached its first abutment at its bottom dead-center. The piston Ps of the valve can therefore absorb only a volume lying in the range zero to said common cylinder capacity. It can be seen that the step of moving the shuttle piston Pa from its top dead-center to its bottom dead-center constitutes a step of loading the device prior to any movement of the valve.

In order to modify timing, the phase of the shafts may be shifted until a maximum phase-shift angle made possible by the phase shifter is available, e.g. for the purpose of advancing the second shaft in operation relative to the first shaft, the opening and closing cams each comprising a base circular arc and a single lobe of profile that is constituted by a rising ramp enabling the corresponding piston to be moved from its bottom dead-center to its top dead-center, followed by a second circular arc concentric with the base circle and of greater diameter, enabling the opening and closing pistons to be held stationary in their top dead-centers, followed by a descending ramp enabling the opening and closing pistons to be returned towards their bottom dead-centers, the central angle of the base circular arc of the opening cam being not less than the central angle of the rising ramp of the closing cam plus the maximum phase-shift angle, the central angle of the base circular arc of the closing cam being not less than the central angle of the descending ramp of the opening cam plus the maximum phase-shift angle.

According to a characteristic of the invention, over the entire phase-shift range, the relative angular setting of the first and second shafts is such that the opening piston leaves its bottom dead-center under the action of the rising ramp of the opening cam after the shuttle piston has reached its top dead-center under the action of the rising ramp of the closing cam, and such that the closing piston reaches its bottom dead-center under the action of the descending ramp of the closing cam before the opening piston leaves its top dead-center under the action of the descending ramp of the opening cam.

Under such conditions, starting from the rest position, the rising ramp of the closing cam C2 begins the working cycle by moving the closing piston P2 from its bottom dead-center to its top dead-center, thereby delivering a common cylinder capacity of fluid into the cavity so as to push back the shuttle piston Pa, without shock, from its top dead-center to its bottom dead-center, thereby activating the device. During this stage, the piston P1 remains at its bottom dead-center defined by the base circle of the cam C1 and the piston Ps remains at its top dead-center. The piston P2 then remains stationary at its top dead-center, as defined by the second circular arc of the cam C2, while the rising ramp of the cam C1 performs the following stage by moving the piston P1 from its bottom dead-center towards its top dead-center in order to deliver a second common cylinder capacity of hydraulic fluid into the cavity that is needed for opening the valve.

In an embodiment of the invention, the relative angular setting of the shafts is defined in such a manner that, for a zero phase-shift angle between the first and second shafts, which angle corresponds to the maximum duration of valve opening, the closing piston leaves its top dead-center after the opening piston has reached its top dead-center, thereby creating an initial phase-shift range in which the valve remains stationary wide opened for a certain length of time at its maximum lift between its opening and closing stages.

For this configuration of the invention, the piston P1 reaches its top dead-center before the piston P2 leaves its top dead-center, and as a result all of the common cylinder capacity of fluid is sucked in by the piston Ps on its own, which opens the valve to its greatest lift allowed in the device, and the valve conserves this lift until the piston P2 leaves its top dead-center as a result of the descending ram of the cam C2, thereby absorbing the flow delivered by the piston Ps during closure of the valve.

In another embodiment of the invention, the relative setting of the shafts is defined in such a manner that, for a zero phase-shift angle between the first and second shafts, the closing piston leaves its top dead-center before the opening piston reaches its top dead-center.

Under such conditions, before the end of the delivery stroke of the piston P1, the piston P2 begins to suck in an increasing fraction of the flow delivered by the piston P1, thereby reducing the total flow sucked in by the piston Ps, and thus reducing the maximum lift of the valve, which maximum lift is reached only at a single angle of rotation of the shafts and not over a certain angular period in the rotation of the shafts.

In an embodiment of the invention that enables the valve to be closed completely, the maximum phase-shift angle of the closing cam relative to the opening cam is sufficient for the closing piston to leave its top dead-center before the opening piston leaves its bottom dead-center, and, at all times during the opening stage of the valve, for the volume of fluid sucked in by the closing piston from its top dead-center to be greater than the volume of fluid delivered by the opening piston from its bottom dead-center, such that the total flow delivered remains less than or equal to the common cylinder capacity, the valve remaining closed throughout the duration of the cycle and the shuttle piston leaving and returning to its bottom dead-center so as to keep the volume of the cavity at its reference value.

In this way, it is possible to phase-shift the cams C1 and C2 in such a manner that the total flow delivered by the pistons P1 and P2 remains less than the common cylinder capacity and that the device is deactivated throughout the duration of the cycle, without being able to move the valve, which is substituted by the piston Pa leaving and returning to its bottom dead-center abutment so as to keep the volume of the cavity at its reference volume.

The angular duration of the opening of the valve and its lift may be adjusted in operation by modifying the phase-shift angle of the second shaft while not shifting the first shaft, or vice versa, or indeed while simultaneously modifying the phase-shift angle of each of the shafts relative to a crank shaft driving said shafts.

Between the zero phase shift where the valve reaches its maximum lift and opening duration, and the maximum phase shift where the valve does not open, the angular duration of valve opening is a continuous decreasing function of the phase-shift angle between the shafts. Lift is also a decreasing function of said phase-shift angle, with maximum lift possibly being maintained during an initial angular period of rotation of the shafts, as mentioned above. The invention thus makes it possible both to adjust the angular duration of opening, and also to adjust the corresponding lift of the valve between a zero value and a maximum value.

If only one phase shifter is available, it is possible to select between a fixed start of opening and a variable end of opening, or vice versa. If two phase shifters are available, it is possible to adjust simultaneously the beginning of opening and the end of opening of the valve.

In all embodiments of the invention, the profiles of the opening and closing cams may be such that a rest period exists during which the valve is in its closed position, the shuttle piston is at its top dead-center, and the opening and closing pistons are at their bottom dead-centers, thereby enabling leaks from the cavity to be compensated in order to recalibrate the reference volume of fluid via one-way communication with a source of fluid at a pressure that is not sufficient to move the shuttle piston.

Such a characteristic makes it possible to eliminate operating slack in the device. Re-establishing some minimum level of pressure in the cavity at the beginning of each cycle guarantees that the pistons are pressed against their cams (directly or indirectly). Furthermore, the stage of activating the device is accompanied by an increase of pressure in the cavity that is proportional to the resilient return force of the shuttle piston Pa that strengthens the mechanical connection between the cams C1, C2 and the valve, thereby performing the conventional function of a silence ramp on the cam.

Modern engines generally have four valves per cylinder, including two identical twin intake valves operating synchronously under the control of two cams of an admission shaft, and two identical twin exhaust valves also operating synchronously under the control of two cams of an exhaust shaft. In order to comply with that architecture, the conventional cam shafts may be replaced in the invention by a tubular shaft carrying fixed cams and phase-shiftable cams, the phase-shiftable cams being keyed to a coaxial shaft inside the tubular shaft and being driven thereby via a phase shifter. The complexity of the shaft having phase-shiftable cams increases with the number of cams per cylinder.

Firstly, accurate synchronization of twin valves assumes that there is a symmetrical hydraulic path between each valve piston and the pistons P1 and P2. Such symmetry requires the fluid flows moved by the pistons P1 and P2 to be combined at a central point and then separated towards the two valve pistons Ps, resulting in an undesirable increase in the reference volume and in undesirable changes in the flow direction of the fluid. A hydraulically advantageous configuration with two fixed opening cams on either side of a single phase-shiftable closing cam is described below. Furthermore, in addition to hydraulic symmetry, synchronizing twin valves assumes that two return springs are accurately identical and that there is the same amount of friction between the two valve stems and their respective guides. A more desirable configuration having only one opening cam and only one closing cam, which cams are disposed side by side, nevertheless makes it possible to guarantee that two twin valves are synchronized. A first solution is characterized in that the two valves are controlled by two independent devices in which the two opening pistons are actuated synchronously by a single opening cam and the two closing pistons are actuated synchronously by a single closing cam. Another solution is characterized in that the two valves are actuated by a single device in accordance with the invention via a synchronizing T-bar.

In order to make all configurations possible, the device of the invention may control a number N of identical valves synchronously and may have a number P of mutually synchronous opening pistons that are actuated by Q identical opening cams, a number R of mutually synchronous closing pistons that are actuated by S identical closing cams, and at least one shuttle piston, the total volume moved by the P opening pistons between their bottom dead-centers and their top dead-centers being identical to the total volume moved by the R closing pistons between their bottom dead-centers and their top dead-centers, and also being identical to the total volume moved by the shuttle piston(s) between its (their) bottom and top dead-centers.

The invention also provides a set of two devices of the above-specified type, each for actuating a single valve, the set being characterized in that the devices share a single opening cam and a single closing cam, so as to ensure that said valves are open and closed synchronously.

In a variant, a single device of the invention actuates at least two identical valves via a T-bar or a synchronization rocker.

In another embodiment, the mechanical T bar is replaced by an hydraulic T bar. The body may include an additional undeformable cavity communicating with the main cavity of the body via the cylinder of the main piston Ps, and communicating with the outside via two secondary cylinders coaxial with the twin valves and containing two secondary pistons Ps of sections smaller than the section of the main cylinder. One of the secondary cylinder is coaxial with the main cylinder, the additional cavity communicating in unidirectional manner with a source of fluid under pressure. Under such circumstances, a main piston Ps slides in the main cylinder, a secondary piston slides in a secondary cylinder, said secondary piston being connected to the first piston and to a first valve of axis parallel to the main and secondary pistons, the other secondary piston slides in the other secondary cylinder, being connected to the other valve of axis parallel to said piston. Moreover, the additional cavity contains a volume of substantially incompressible fluid that is equal to the volume of said additional cavity when the first and second valves are resting on their seats in the closed positions of said valves.

The device of the invention may also include means for retracting the first abutment for the bottom dead-center of the shuttle piston so that said piston can suck in the algebraic sum of the volumes of fluid delivered by the opening piston and the closing piston so as to prevent the valve from opening regardless of the phase-shift angle between the opening shaft and the closing shaft.

It is thus easy to deactivate and/or reactivate one or more cylinders of an engine.

Finally, the invention also provides a method of operating a control device of the above-specified type, characterized in that at each revolution of the shafts it executes an opening and closing cycle of the valve, which cycle comprises successive steps starting from a rest position of the control device in which the valve rests against its seat, in which the opening and closing pistons are at their bottom dead-centers, and in which the shuttle piston is at its top dead-center, the steps consisting in:

moving the closing piston from its bottom dead-center to its top dead-center by means of the rising ramp of the closing cam so as to push the shuttle piston from its top dead-center to its bottom dead-center in order to activate the control device, the opening piston remaining at its bottom dead-center by means of the base circular arc of the opening cam;

moving the opening piston by means of the rising ramp of the opening cam so as to open the valve, the closing piston remaining at its top dead-center by means of the second circular arc of the closing cam;

adjusting the lift and the duration of the opening of the valve by shifting the phase of the closing cam relative to the opening cam so as to move the closing piston from its top dead-center by means of the descending ramp of the closing cam at any moment during the delivery stroke of the opening piston by means of the rising ramp of the opening cam, before it reaches its top dead-center;

continuing to move the closing piston to its bottom dead-center by means of the descending ramp of the closing cam so as to close the valve, the opening piston remaining at its top dead-center by means of the second circular arc of the opening cam; and moving the opening piston from its top dead-center towards its bottom dead-center by means of the descending ramp of the opening cam, so as to move the shuttle piston from its bottom dead-center to its top dead-center and deactivate the device.

BRIEF DESCRIPTION OF THE DRAWINGS

The invention can be better understood and other details, characteristics, and advantages of the invention appear on reading the following description made by way of non-limiting example with reference to the accompanying drawings, in which.

DETAILED DESCRIPTION OF THE PREFERRED EMBODIMENT

Figure 1:
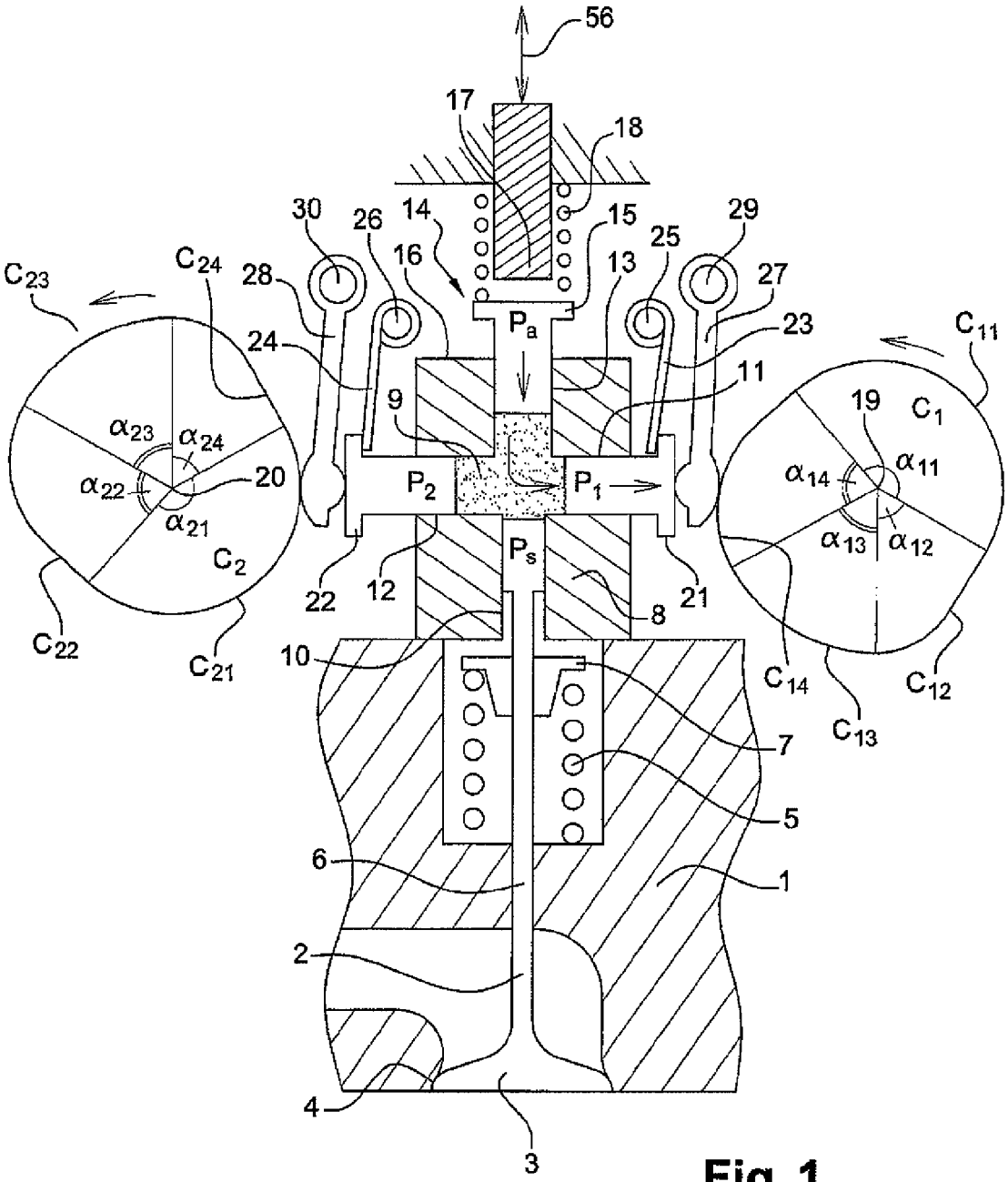
FIG. 1 is a diagrammatic view of a device for controlling a single valve in a first embodiment of the invention in which the valve is actuated by two parallel cam shafts carrying opening and closing cams that are identical and inverted.

Reference is made to FIG. 1 which shows a first embodiment of a control device of the invention, mounted on the cylinder head 1 of a reciprocating internal combustion engine.

The cylinder head 1 is conventionally fitted with at least one valve 2, e.g. an intake valve, having a valve member or "plug" 3 held pressed against a sealing seat 4 of the cylinder head 1 by a return spring 5. The valve 2 also includes a stem 6 opposite from the plug 3 and supporting a cup 7 that bears against one end of the return spring 5. The other end of the return spring bears for example directly against the cylinder head 1.

The device of the invention comprises a body 8 fastened to the cylinder head 1, e.g. by screws, and surrounding a cavity 9 communicating with the outside via four orthogonal cylinders 10, 11, 12, and 13.

A piston Ps is fastened to the free end of the stem 6 of the valve 2 and is slidably mounted in the first cylinder 10 of the body 8.

The piston Ps is movable between a top dead-center (FIG. 1) in which the valve 2 is closed, i.e. is resting against its seat 4, and a bottom dead-center for which the valve 2 is open and at its maximum adjustable lift, i.e. it is separated from the seat 4.

The pistons P1, P2, and Pa, referred to respectively as the opening piston, the closing piston, and the shuttle piston are slidably mounted in the cylinders 11, 12, and 13 respectively of the cavity 9.

The pistons P1, P2, Pa, and Ps define a portion of the cavity 9 that is filled with a substantially constant volume of incompressible fluid, such as oil, with sealing being provided by the pistons P1, P2, Pa, and Ps. The volume of fluid in the cavity 9 is the above-defined reference volume that does not vary in operation with the exception of possible leaks that can be compensated, as is described in fuller detail below.

In this example, the pistons P1 and P2 are on the same axis, as are the pistons Pa and Ps. The pistons P1 and P2 are also oriented perpendicularly relative to the pistons Pa and Ps.

The piston Pa has an outside end 14, i.e. an end opposite from the cavity 9, that includes a collar 15 suitable for coming into abutment against an outside face 16 of the body 8 (inner abutment). The outside end 14 of the piston Pa is also suitable for coming to bear against a stationary outer abutment 17 (outer abutment). The piston Pa is thus movable between its inner and outer abutments, a return spring 18 tending to urge the shuttle piston Pa towards its inner abutment.

The shuttle piston Pa is thus movable between a top dead-center defined by the inner abutment, and a bottom dead-center defined by the outer abutment.

The piston P1 is actuated by an opening cam C1 driven in rotation about an axis 19 by a first shaft (not shown).

The piston P2 is actuated by a closing cam C2 driven in rotation about an axis 20 by a second shaft (not shown), synchronously and in parallel with the first shaft, and perpendicular to the plane of the section of FIG. 1. The axes 19 and 20 intersect the axis that is common to the pistons P1 and P2. The direction of rotation of the cams C1 and C2 is represented by arrows in FIG. 1, and in this figure it corresponds to the counterclockwise direction.

The device of the invention also includes phase shifter means (not shown) for shifting the phase of the second shaft relative to the first shaft, or vice versa.

In this way, it is possible in operation to adjust the angular position of the closing cam C2 relative to the opening cam C1, or vice versa.

Figure 2A:
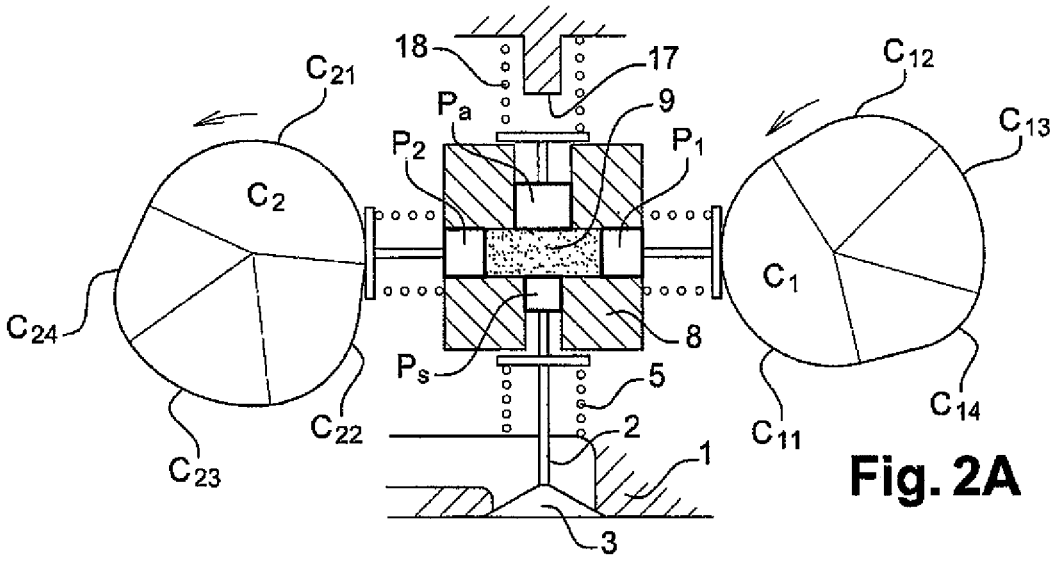
FIGS. 2A to 2E are diagrammatic views showing the various steps in an operating cycle of the FIG. 1 control device.
Figure 2B:
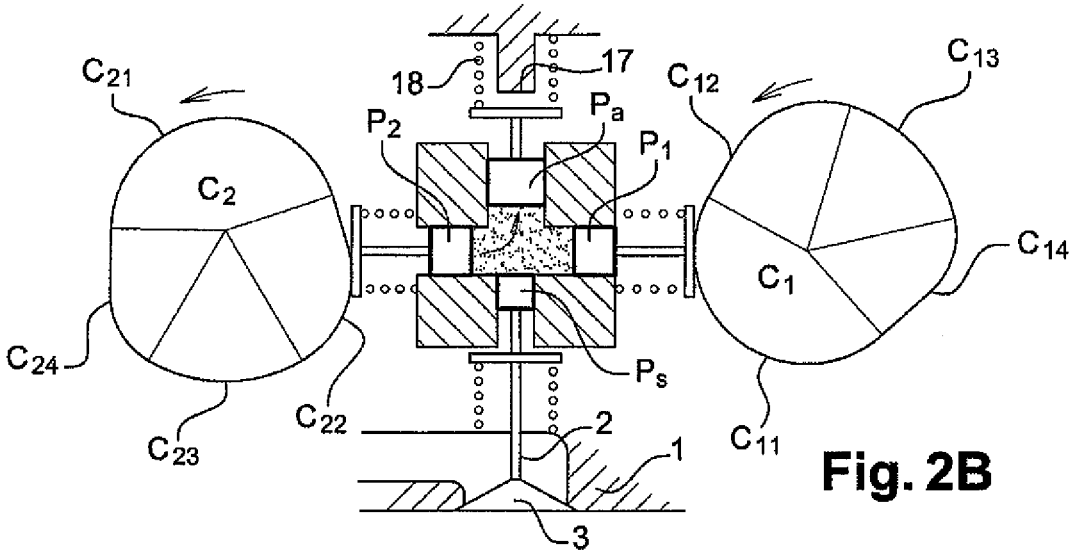
Figure 2C:
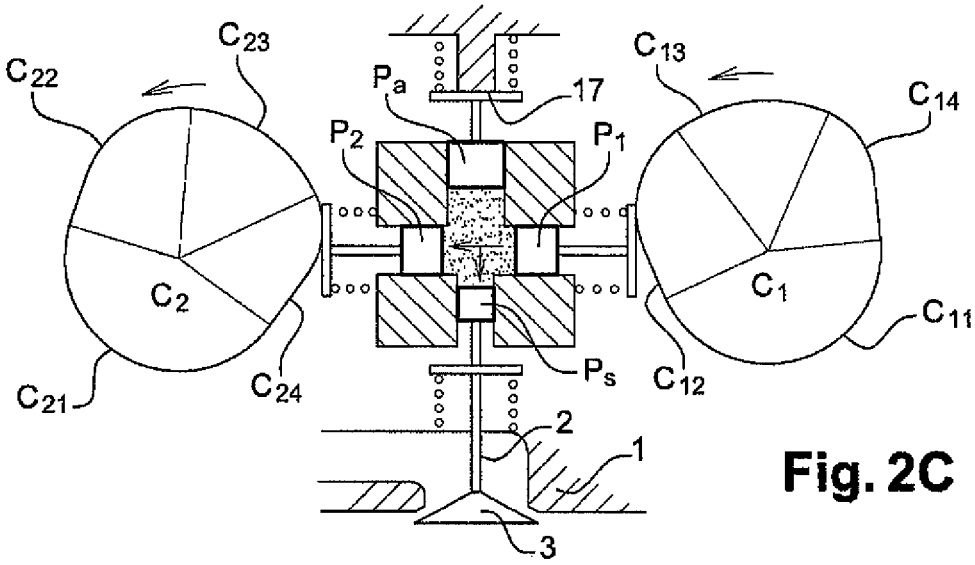
Figure 2D:
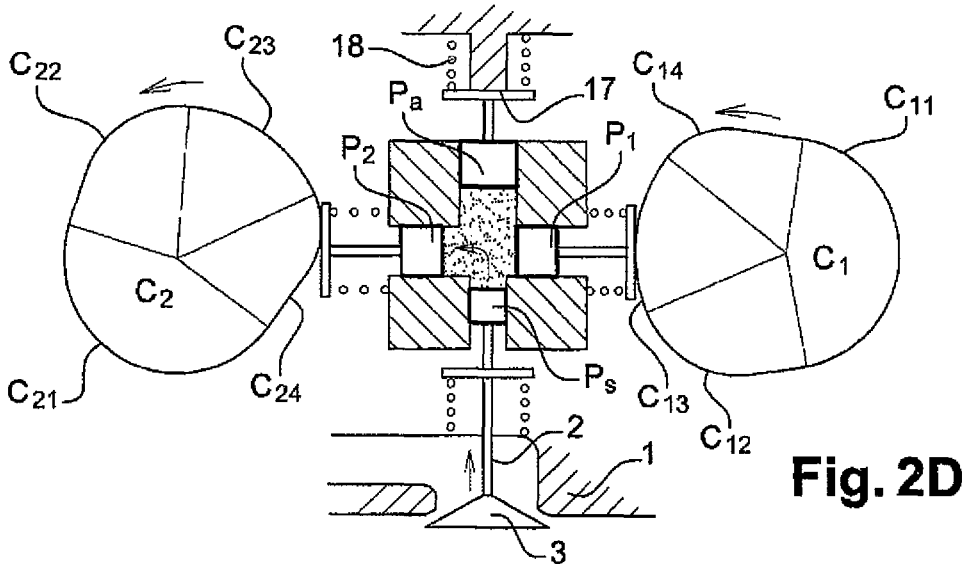
Figure 2E:
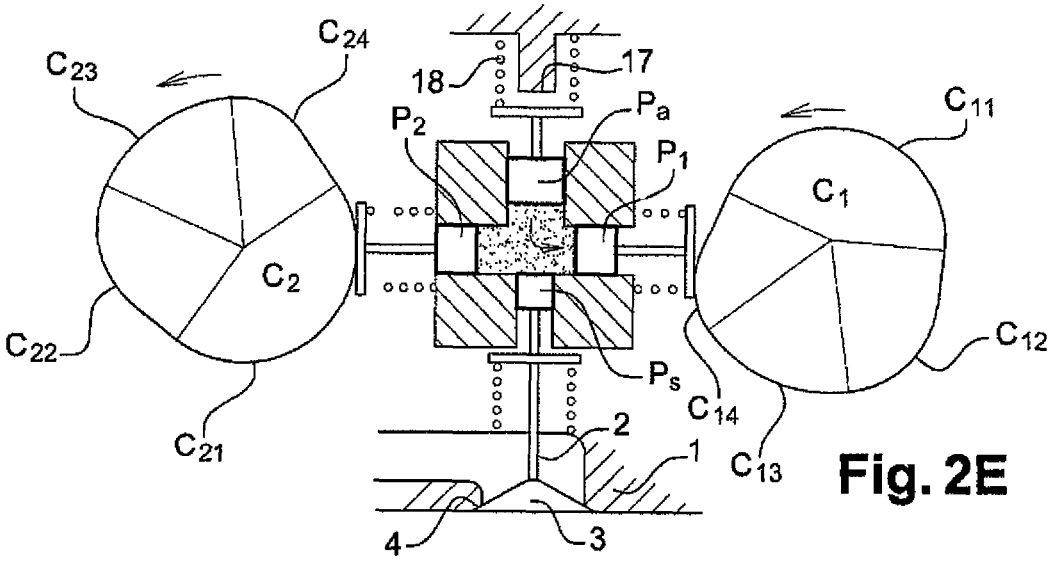
Figure 3:
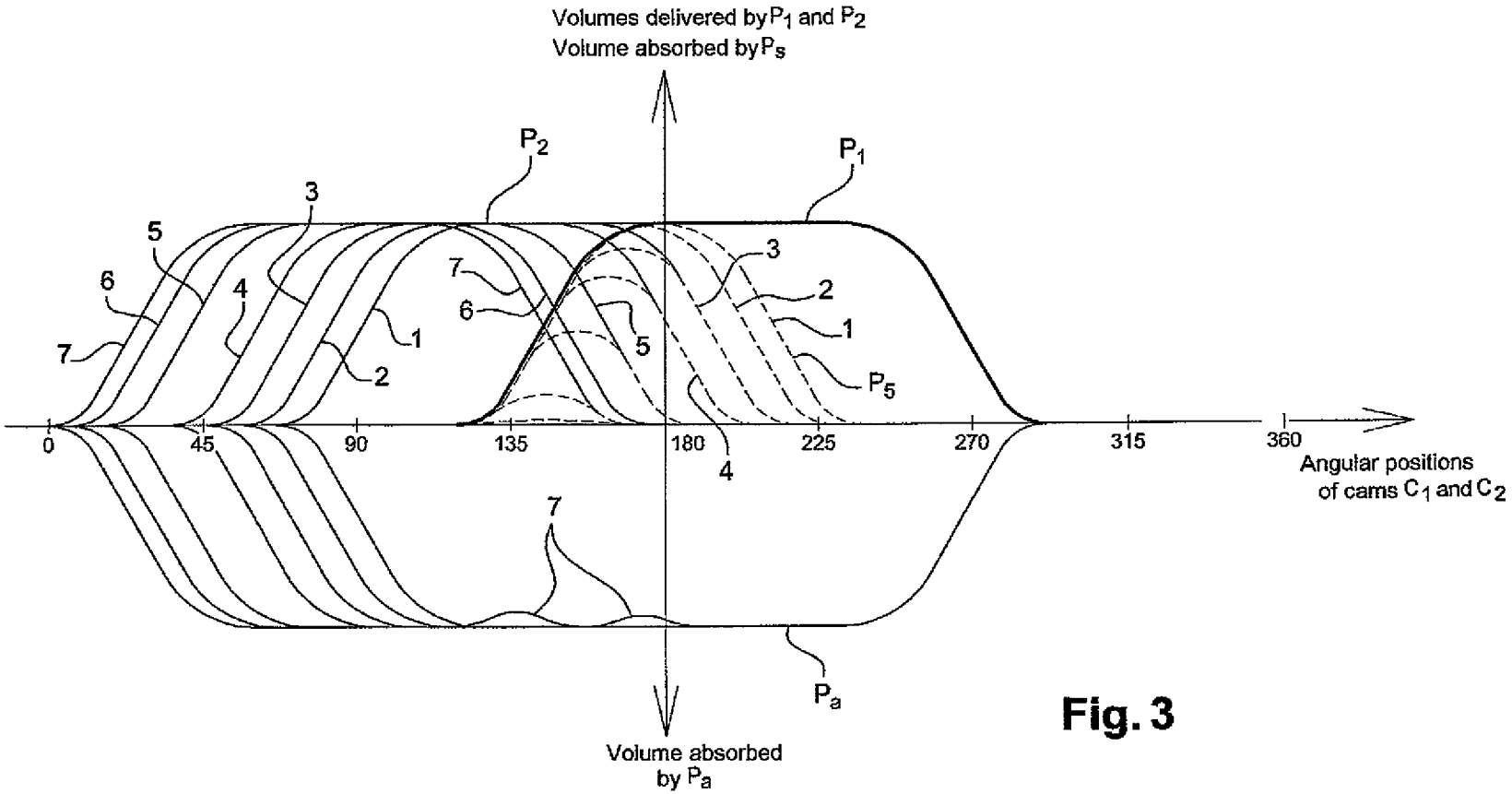
FIG. 3 is a diagram showing the volumes delivered by the opening and closing pistons, the volume absorbed by the valve piston, and the volume absorbed by the shuttle piston, all as a function of the angular position of the cams for various angular offsets between the opening and closing cams.

In the embodiment of FIGS. 1 to 3, the second shaft (and thus the closing cam C2) may be advanced in operation relative to the first shaft (and thus relative to the opening cam C1), up to a maximum phase-shift angle.

The outside ends of the pistons P1 and P2 have collars 21 and 22 that co-operate with torsion springs 23 and 24 mounted around stationary pins 25 and 26 and tending to urge the pistons P1 and P2 outwards from the cavity, i.e. towards their bottom dead-centers, so that the outside ends of the pistons P1 and P2 bear respectively against the opening and closing cams C1 and C2 via rockers 27 and 28 that pivot about stationary axes 29 and 30 in order to avoid imparting radial forces to the pistons P1 and P2.

Each of the opening and closing cams C1 and C2 has a respective base circular arc C11, C21 centered on the axis of rotation 19, 20 of the cam C1, C2 and a single lobe of profile that is constituted by a rising ramp C12, C22 enabling the corresponding piston P1, P2 to be moved from its bottom dead-center to its top dead-center, followed by a second circular arc C13, C23 concentric with the base circle C11, C21 and of greater diameter, enabling the opening and closing pistons P1 and P2 to be held at their top dead-centers, followed by a descending ramp C14, C24 enabling the opening and closing pistons P1 and P2 to be returned towards their bottom dead-centers. The central angle $\alpha 11$ of the base circular arc C11 of the opening cam C1 is not less than the central angle $\alpha 22$ of the rising ramp C22 of the closing cam C2 plus the maximum phase-shift angle between the first and second shafts. In addition, the central angle $\alpha 21$ of the base circular arc C21 of the closing cam C2 is not less than the central angle $\alpha 14$ of the descending ramp C14 of the opening cam C1 plus the maximum phase-shift angle. The profiles of each of the cams C1 and C2 are continuous.

The rising ramp C12 of the opening cam C1 and the descending ramp C24 of the closing cam C2 are so-called "fast" ramps. The rising ramp C22 of the closing cam C2 and the descending ramp C14 of the opening cam C1 are so-called "slow" ramps.

The central angles $\alpha 12$, $\alpha 24$ of the fast ramps C12, C24 are less than the central angles $\alpha 14$, $\alpha 22$ of the slow ramps C14, C22.

The opening and closing cams C1 and C2 are inverted in the sense that the fast ramp C24 of the closing cam C2 is a descending ramp when the fast ramp C12 of the opening cam C1 is a rising ramp, and the slow ramp C22 of the closing cam C2 is a rising ramp when the slow ramp C14 of the opening cam C1 is a descending ramp.

The central angles $\alpha 13$, $\alpha 23$ of the second circular arcs C13, C23 are equal to the central angles $\alpha 12$, $\alpha 24$ of the fast ramps C12, C24 so as to be capable of reaching the maximum lift of the valve 2 that the device is capable of achieving.

The pistons P1 and P2 are identical, and between their bottom and top dead-centers, each of them displaces the same volume as the piston Pa. This volume is referred to as the common cylinder capacity. The stroke and the diameter of the piston Pa may differ from the stroke and the diameter of the pistons P1 and P2 in order to optimize the return spring 18 that acts in the cavity 9 to generate pressure that is much lower than the pressure generated by the spring 5 of the valve 2, given the low inertia of the piston Pa and the slowness of the ramps C14 and C22.

The return springs 18, 5 of the shuttle piston Pa and of the valve 2 are such that the fluid pressure needed for moving the shuttle piston Pa to its bottom dead-center is less than the pressure needed for opening the valve 2.

Figures 4A, 4B:
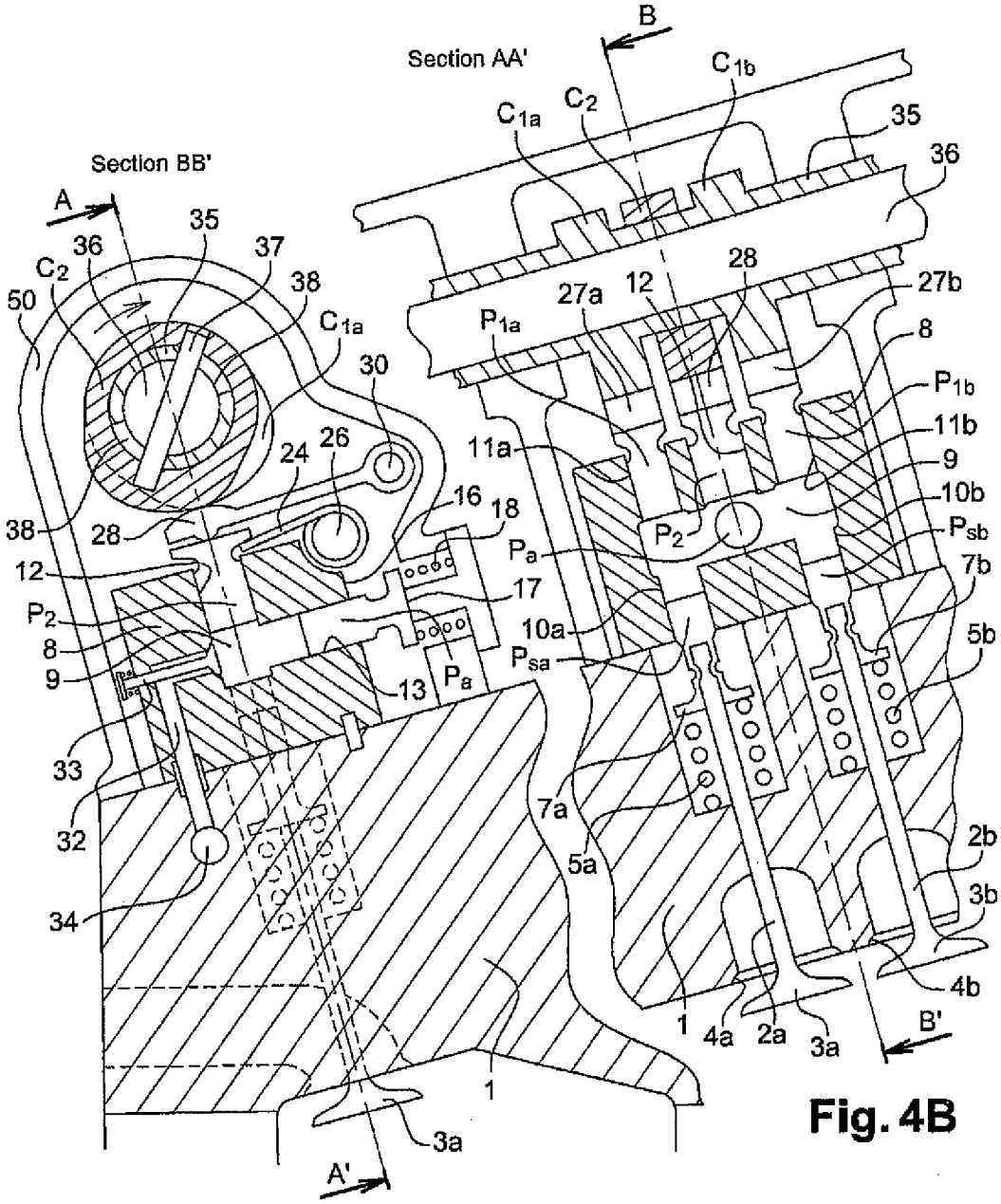
FIGS. 4A and 4B are section views respectively on lines BB' and AA' of FIGS. 4B and 4A, showing a second embodiment of the invention in which two coaxial shafts carry three cams per cylinder for actuating two identical or twin valves synchronously.
Figure 5A:
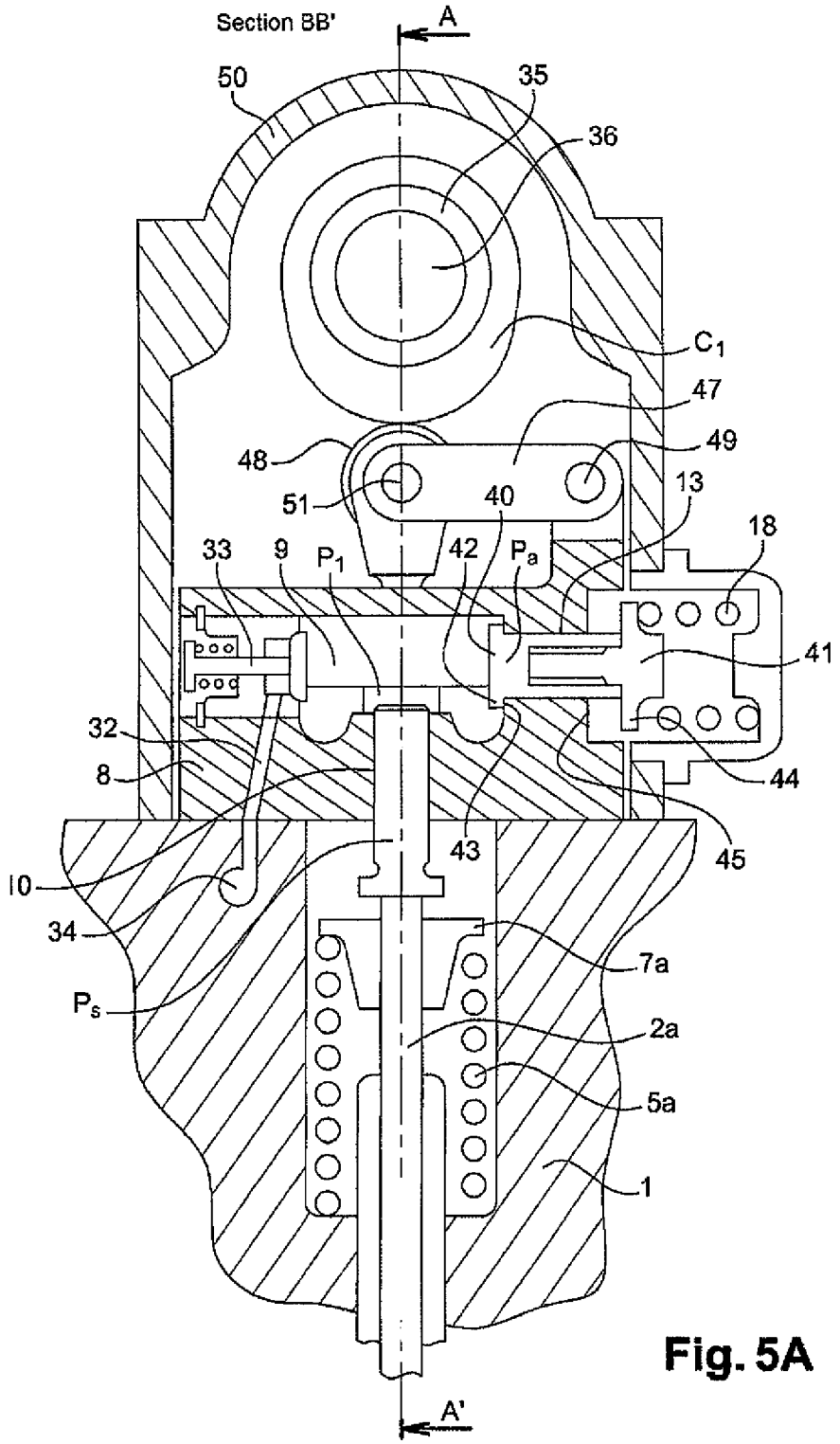
FIGS. 5A and 5B are section views respectively on lines BB' and AA' of FIGS. 5B and 5A showing a third embodiment of the invention in which two coaxial shafts carry two cams per cylinder for synchronously actuating two identical or twin valves, via a T-bar.

The device of the invention also includes means for recalibrating the reference volume of fluid in the cavity 9, said means comprising a duct 32 for feeding incompressible fluid and fitted with a check valve 33 that serves to connect a source 34 of fluid under pressure to the cavity 9 (see FIGS. 4A and 5A). The pressure of the fluid from the feed duct 32 is not sufficient to move the piston Pa. Such recalibration means are known from document WO 02/48510 in the name of the Applicant.

Reference is now made to FIGS. 2A to 2E that show the various steps in the operation of the FIG. 1 control device for the duration of a cycle performed by one complete rotation of the cams C1 and C2. The cycle that is shown corresponds to an intermediate phase shift between the cams C1 and C2, corresponding to an intermediate maximum lift of the valve 2 (see for example curve 5 in FIG. 3).

FIG. 2A shows the device at the end of the stage of recalibrating the reference volume of fluid in the cavity 9 via the above-mentioned recalibration means. In this position, the pistons P1 and P2 are at bottom dead-center on the base circles C11, C21 of the cams C1 and C2, with the pistons Ps and Pa being at top dead-center under the action of the return springs 5 and 18. During this rest stage, rotation of the cams C1, C2 produces no movement of the pistons or of the hydraulic fluid in the cavity 9.

FIG. 2B shows the device during the second stage of the cycle, referred to as the loading stage, in which the piston P1 remains stationary at its bottom dead-center on the base circle C11 of the cam C1 while the piston P2 on the slow rising ramp C22 of the cam C2 is driving a first common cylinder capacity of fluid into the cavity 9, thereby pushing away the shuttle piston Pa, which shuttle piston goes from its top dead-center to its bottom dead-center with the pressure in the cavity 9 rising in order to compress the return spring 18 of the piston Pa.

FIG. 2C shows the device at the end of the third stage of the cycle, the stage in which the valve 2 is opened, in which the valve 2 reaches its maximum lift when the piston P1 on the fast rising ramp C12 of the cam C1 delivers a second common cylinder capacity of fluid into the cavity 9 and the piston P2 on the fast descending ramp C24 of the cam C2 sucks in a fraction of the volume delivered by P1 in order to limit the volume of fluid pressing against the piston Ps and in order to reduce the maximum lift of the valve 2 that is reached when the volume remaining to be delivered by the piston P1 is equal to the volume that has already been sucked in by the piston P2.

FIG. 2D shows the device at the end of the fourth stage of the cycle, the stage for closing the valve 2, in which the piston P1 is stationary at its top dead-center against the second circular arc C13 of the cam C1 while the piston P2 against the fast descending ramp C24 of the cam C2 is sucking in the fluid delivered by the piston Ps under the action of the return spring 5 closing the valve 2.

FIG. 2E shows the device during the fifth stage of the cycle, referred to as the unloading stage, in which the valve 2 is back against its seat 4 and the piston Ps has returned to top dead-center, where the piston P2 is back at bottom dead-center and the piston P1 on the slow descending ramp C14 of the cam C1 sucks in the common cylinder capacity delivered by the piston Pa under the action of its return spring 18 so as to unload the device and return to the position of FIG. 2A from which a new cycle can be started.

Reference is now made to FIG. 3 which is an operating diagram of the FIG. 1 device, with the angle of rotation of the cams C1 and C2 between the beginning and the end of a cycle being plotted along the abscissa axis, with the volume of fluid delivered by the piston P1 (bold line), the volume of fluid delivered by the piston P2 (fine line), and the volume of fluid absorbed by the piston Ps of the valve 2 (dashed line) all being plotted up the positive ordinate axis, and with the volume of fluid absorbed by the shuttle piston Pa being plotted down the negative ordinate axis. The curves numbered 1 to 7 correspond to seven successive phase shifts between the shafts, the first curve 1 corresponding to a zero angle in which the valve 2 is wide open, and the last curve 7 corresponding to a phase shift of 50 degrees, for which the valve 2 is no longer opens.

The dashed-line curves thus also show the lift relationships of the valve 2 for the seven phase shifts. It should be recalled that the lift of a valve 2 is the distance between the bearing surface of its plug 3 and the seat 4 in the cylinder head 1.

It should be observed that the above-mentioned control device makes it possible, in operation and by adjusting the phase shifts between the two shafts, to adjust the maximum lift of the valve 2 and simultaneously to offset the closure angle of the valve 2 so as to adjust the angular duration for which the valve 2 is open, and if necessary to keep the valve 2 closed throughout the duration of a cycle.

In FIG. 3, the relative angular setting between the shafts is defined in such a manner that for a zero phase-shift angle (curve 1), the closing piston P2 leaves its top dead-center at the same time as the opening piston P1 reaches its top dead-center, such that the maximum lift of the valve 2 that the device is capable of achieving is reached for a single angle of the cycle.

In a variant that is not shown, it is possible to define the relative angular setting of the shafts in such a manner that for a zero phase-shift angle between the first and second shafts, the closing piston P2 leaves its top dead-center after the opening piston P1 has reached its top dead-center, in such a manner as to create an adjustable angular period in the cycle at which the valve 2 remains stationary at its maximum lift between its opening and closing stages.

In another variant, the device may include means for restarting the bottom dead-center abutment 17 of the shuttle piston Pa (shown diagrammatically in FIG. 1 as an arrow 56), so that the piston Pa is capable of sucking in the algebraic sum of the volumes of fluid delivered by the opening piston P1 and by the closing piston P2, so as to prevent the device being loaded regardless of the phase-shift angle between the opening shaft and the closing shaft.

FIGS. 4A and 4B show a control device in a second embodiment of the invention, for synchronously actuating two identical or twin valves 2*a* and 2*b* via three cams C1*a*, C1*b*, and C2, so as to provide the device with hydraulic symmetry.

In this embodiment, the twin valves 2*a*, 2*b* have parallel axes and are actuated by two coaxial shafts 35, 36 of axis lying in the plane of the axes of the valves 2*a*, 2*b* and extending perpendicularly to said axes, the shafts respectively carrying two openings cams C1*a*, C1*b* and one closing cam C2.

The opening cams Ca1 and C1*b* are arranged symmetrically on either side of the closing cam C2. The identical profiles of the cams C1*a* and C1*b*, and the profile of the cam C2 are similar to the profiles described above.

The body 8 includes a cavity 9 and has a plane of symmetry BB'. The cavity 9 opens to the outside via six cylinders, respectively two parallel symmetrical cylinders 10*a* and 10*b* in which there slide two pistons Psa and Psb fastened to the free ends of the stems of the valves 2*a* and 2*b*, two other symmetrical mutually parallel cylinders 11*a* and 11*b* in which there slide two opening pistons P1*a* and P1*b*, a first central cylinder 12 in which there slides a closing piston P2, and a second central cylinder 13 perpendicular thereto in which there slides a shuttle piston Pa.

The pistons Psa, Psb of the valves 2*a*, 2*b*, the opening pistons P1*a*, P1*b*, and the closing piston P2 are mutually parallel. The shuttle piston Pa is orthogonal to the above-mentioned pistons Psa, Psb, P1*a*, P1*b*, and P2.

The axes of the closing piston P2 and of the shuttle piston Pa are situated in the plane of symmetry BB' of the body 8.

As above, the shuttle piston Pa is movable between inner and outer abutments 16 and 17 defining respectively its top and bottom dead-centers, there being a return spring 18 urging it towards its inner abutment 16.

The return springs 18, 5*a*, 5*b* of the shuttle piston Pa and of the valves 2*a* and 2*b* are such that the pressure of fluid needed to move the shuttle piston Pa to its bottom dead-center is less than the pressure needed to open either of the valves 2*a*, 2*b*.

The two opening cams C1*a*, C1*b* are identical, as are the two openings pistons P1*a*, P1*b*, the two valve pistons Psa, Psb, the two valves 2*a*, 2*b*, and the two return springs 5*a*, 5*b*. The control device is thus symmetrical relative to the plane BB'.

As above, each valve 2*a*, 2*b* has a plug 3*a*, 3*b* for pressing against a seat 4*a*, 4*b* of a cylinder head 4 on which the body 8 is fastened, e.g. by screws.

Each cam C1*a*, C1*b*, C2 actuates the corresponding piston P1*a*, P1*b*, P2 via a tongue 27*a*, 27*b*, 28 that pivots about a respective axis 29*a*, 29*b*, 30. The opening pistons P1*a*, P1*b* and the closing pistons P2 are held in contact with the tongues 27*a*, 27*b*, 28, and the tongues 27*a*, 27*b*, 28 are held in contact with the cams C1*a*, C1*b*, C2 by means of return springs 23*a*, 23*b*, 24 urging the pistons P1*a*, P1*b*, P2 towards their bottom dead-centers.

The closing cam C2 is secured to the inner shaft 36, which shaft is coupled to the coaxial outer shaft 35 that carries the opening cams C1*a*, C1*b* via a phase shifter (not shown). Such a phase shifter is well known in the state of the art and is not described in detail herein.

The closing cam C2 is secured to the inner shaft 36 by a pin 37 that passes through the outer shaft 35 via two oblong slots 38 that make the desired phase variation possible.

The volume moved by the closing piston P2 and by the shuttle piston Pa is equal to twice the volume moved by each opening piston P1*a*, P1*b*.

As above, the cavity 9 also communicates with a source 34 of fluid under pressure via a duct 32 that is fitted with a check valve 33 having its axis in the plane of symmetry BB'.

Since the device is completely symmetrical about the plane BB', the opening and closing streams of the twin valves 2*a*, 2*b* follow identical hydraulic paths, thereby guaranteeing that the valves 2*a* and 2*b* operate synchronously providing their return springs 5*a* and 5*b* are accurately identical.

The control device is housed inside a cam shaft support 50 that is fastened to the cylinder head 1, e.g. by screws.

The operation of such a control device is similar to that described with reference to FIGS. 1 to 3.

Figure 5B:
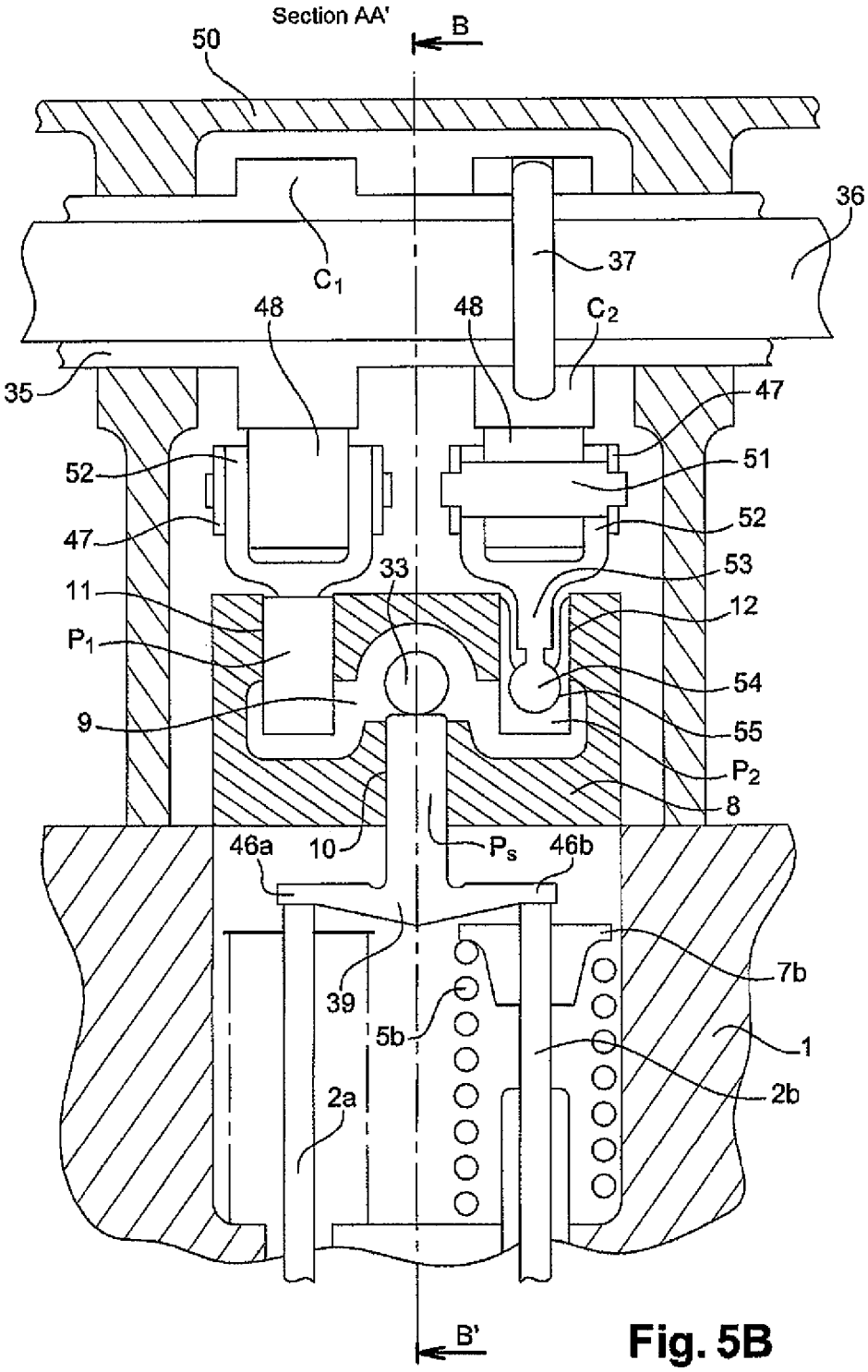

A control device in a third embodiment is shown in FIGS. 5A and 5B. This device seeks to guarantee synchronism between the two twin valves 2*a* and 2*b* by mechanical means, even if their return springs 5*a* and 5*b* are not accurately identical, by using an asymmetrical hydraulic circuit that is activated by only two cams.

In this embodiment, the twin valves 2*a* and 2*b* have axes that are parallel and they are actuated via a T-bar 39 by two coaxial shafts, respectively an outer shaft 35 and an inner shaft 36 respectively carrying an opening cam C1 and a closing cam C2. The profiles of the cams C1 and C2 are similar or identical to those described above.

The body 8 has a cavity 9 and a plane of symmetry BB'. The cavity 9 leads to the outside via four cylinders, respectively a cylinder 10 in which there slides a piston Ps formed by a portion of the T-bar 39 (FIG. 5B), a cylinder 11 in which there slides an opening piston P1, a cylinder 12 in which there slides a closing piston P2, and a cylinder 13 in which there slides a shuttle piston Pa. The opening piston P1 and the closing piston P2 are parallel with each other. The shuttle piston Pa is orthogonal to the above-mentioned pistons P1, P2, and Ps, for example.

The shuttle piston Pa and the piston Ps of the T-bar 39 have their axes in the plane of symmetry BB' of the body 8. The opening and closing pistons P1 and P2 are identical and they are arranged on either side of the plane of symmetry BB' of the body 8.

As above, the shuttle piston Pa is movable between two abutments, respectively defining its top and bottom dead-centers, a return spring 18 urging it towards its top dead-center.

More particularly, the shuttle piston Pa is made up of two portions 40 and 41 that are assembled together, e.g. by screw fastening, a first portion 40 having a collar 42 for coming into abutment against an internal sealing seat 43 of the cylinder 13, thereby defining the bottom dead-center abutment and limiting leaks, while a second portion 41 having a collar 44 serves to come into abutment against an outside wall 45 of the body 8 so as to define the top dead-center abutment.

The return springs 18, 5*a*, 5*b* of the shuttle piston Pa and of the valves 2*a*, 2*b* are such that the fluid pressure needed for moving the shuttle piston Pa to its bottom dead-center is less than the pressure needed for opening the valves 2*a*, 2*b*.

As above, each valve 2*a*, 2*b* has a plug 3*a*, 3*b* for pressing against a seat 4*a*, 4*b* of a cylinder head 1 on which the body 8 is fastened, e.g. by screws.

The free ends of the stems of the valves 2*a*, 2*b* bear against respective ones of the side arms 46*a*, 46*b* of the T-bar 39. More particularly, the T-bar 39 has a central portion acting as the piston Ps that is received in the cylinder 10 of the body 8, and two symmetrical side arms 46*a*, 46*b* that extend sideways on either side of the central portion. Movement of the T-bar 39 thus leads to synchronous movement of the twin valves 2*a*, 2*b* even if the return springs 5*a*, 5*b* of said valves 2*a*, 2*b* are not accurately identical.

Each cam C1, C2 actuates the corresponding piston P1, P2 via a rocker with a hinged roller. Each hinged rocker has an arm 47 that pivots about a stationary axis 49 and that carries the axle 51 of a roller 48 in contact with the cam.

Each rocker also has a fork hinged on the axle 51 of the roller 48, with two side branches 52 extending on either side of the roller 48 with the axle 51 passing therethrough, and a central branch 53 holding the side branches 52 together, and carrying a rod whose end has a ball 54 trapped in a complementary spherical housing 55 formed in the corresponding piston P1, P2, thereby forming a ball joint between the fork and the corresponding piston P1, P2.

The rollers 48 are held in contact with the cams C1, C2 by means of return springs that are not shown.

The inner shaft 36 is coupled to the coaxial outer shaft 35 via a phase shifter that is not shown.

The closing cam C2 is secured to the inner shaft 36 by a pin 37 that passes through outer tube 35 via two oblong slots that make the desired phase variation possible.

The volumes moved by the opening piston P1, by the closing piston P2, and by the shuttle piston Pa are mutually equal.

As above, the cavity 9 also communicates with a source 34 of fluid under pressure via a duct 32 that has a check valve 33.

As above, the control device is housed inside a common cam shaft support 50 that is fastened on the cylinder head 1, e.g. by screws.

The operation of such a control device is similar to that described with reference to FIGS. 1 to 3.

This simple embodiment in which the twin valves 2*a* and 2*b* are actuated synchronously by a mechanical T-bar 39 nevertheless presents the following drawbacks:

the twin valves 2*a* and 2*b* are necessarily on parallel axes with identical strokes; and only one of the two valves 2*a* and 2*b* benefits from hydraulic cancellation of its operating clearance, the other one not coming into contact with its seat unless its shape is perfect.

Figure 6:
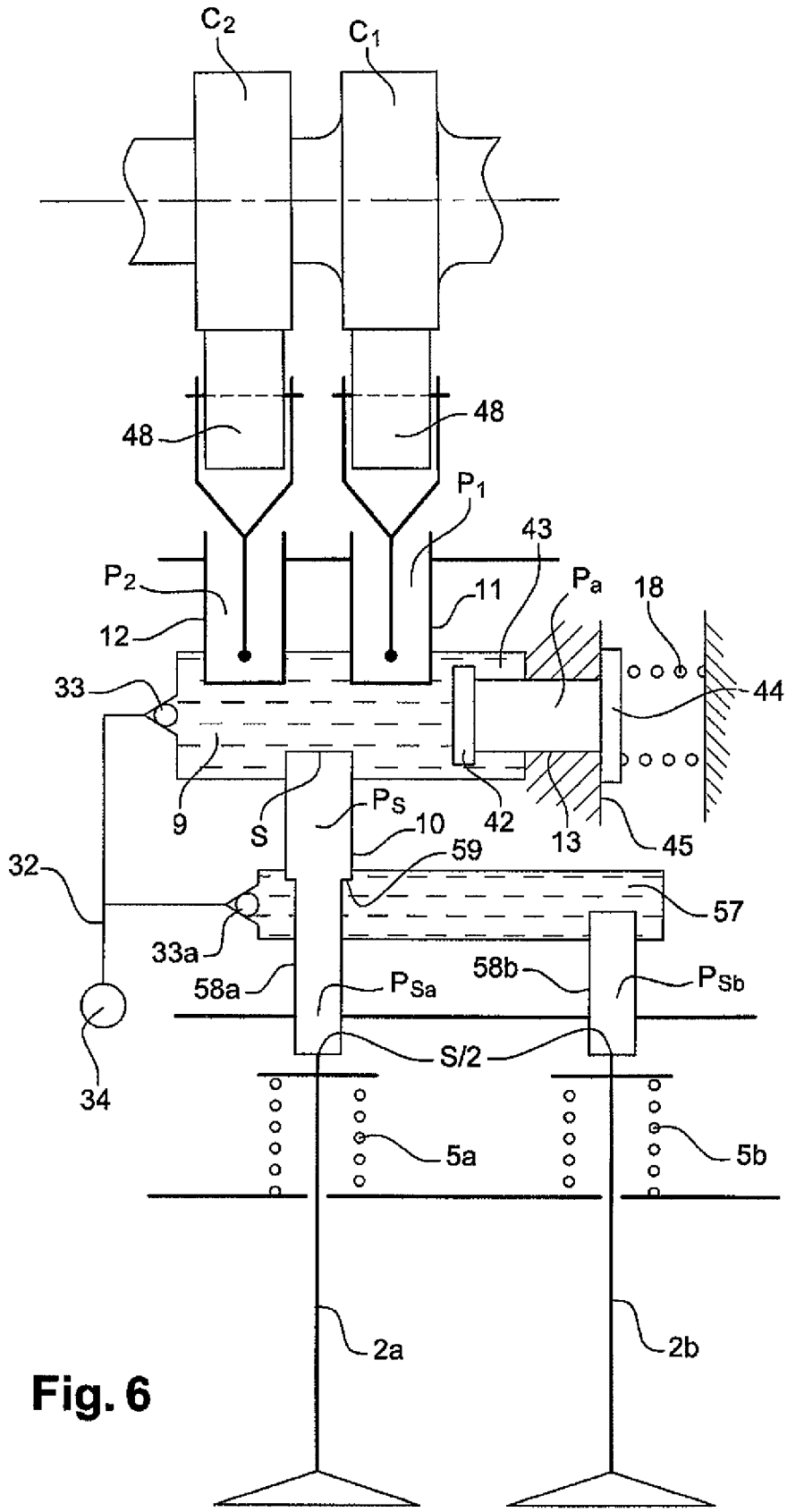
FIG. 6 is a section view of a fourth embodiment of the invention.

To mitigate those drawbacks, the mechanical T-bar 39 is advantageously replaced by hydraulic synchronization based on the principle shown diagrammatically in FIG. 6. The hydraulic synchronization has the following purposes:

eliminating the operating clearances of both twin valves 2*a* and 2*b*, and actuating the twin valves 2*a* and 2*b* along axes that are not parallel; and actuating the twin valves 2*a* and 2*b* with unequal amounts of lift.

To simplify explanation, FIG. 6 shows two twin valves 2*a* and 2*b* that are parallel and with equal amounts of lift.

A control device in this fourth embodiment as shown in FIG. 6 is identical to the preceding embodiment as far as the cylinder 10 in which the piston Ps slides. In this new embodiment, the body 8 has an additional non-deformable hydraulic cavity 57 in communication with the cavity 9 via the cylinder 10 and communicating with the outside via a cylinder 58*a* of axis parallel to the cylinder 10, and preferably on the same axis as the cylinder 10, and also via a cylinder 58*b* that is not necessarily parallel to the cylinder 58*a*. A piston Ps slides in the cylinder 10 and is secured to a piston Psa of smaller diameter (half the section in the figure), that slides in the cylinder 58*a* and that is secured to and parallel with the stem of the valve 2*a*. A piston Psb of arbitrary section (half a section of Ps in FIG. 6) is secured to and parallel with the stem of the valve 2*b* and slides in the cylinder 58*b*. The cavity 57 closed by the pistons Ps, Psa, and Psb contains a constant volume of hydraulic fluid equal to its volume when the valves 2*a* and 2*b* are resting against their seats in the closed position. To compensate for leaks, the cavity 57 communicates with the pressure source 34 via a check valve 33*a*. In this embodiment, the piston Ps actuated the valve 2*a* by the piston Psa, the assembly being held together mechanically and thus presenting the same stroke. The operating clearance for the valve 2*a* is eliminated by the check valve 33. Simultaneously, the piston Ps delivers a volume of oil into the cavity 57 that is proportional to the difference in section between the pistons Ps and Psa, which is absorbed by the movement of the piston Psb that actuates the valve 2*b*. The operating clearance of the valve 2*b* is eliminated by the check valve 33*a*. This embodiment enables the piston Ps to move the valves 2*a* and 2*b* synchronously with different lifts and with travel axes that are not parallel. The lift of the valve 2*b* is equal to the lift of the valve 2*a* multiplied by the ratio between the section difference Ps−Psa and the section Psb.

Having described the invention, the following is claimed:

1. A control device for actuating at least one valve, e.g. for a reciprocating engine, the valve being driven with reciprocating motion in rectilinear translation to open or close an orifice having a sealing seat, said valve including resilient return means urging said valve towards a closed position, said device comprising a body including a non-deformable cavity communicating exclusively with the outside via at least four rectilinear cylinders that are closed respectively by four pistons (P1, P2, Pa, Ps), each of said pistons being movable in reciprocating motion between a respective bottom dead-center remote from the inside of the non-deformable cavity and a top dead-center close to the inside of the non-deformable cavity, the device being characterized in that said pistons comprise a piston (Ps) mechanically connected to the valve and opposing its return means, an opening piston (P1) actuated by an opening cam (C1) that is driven in rotation by a first shaft, a closing piston (P2) actuated by a closing cam (C2) that is driven in rotation by a second shaft that rotates synchronously with the first shaft and that may be offset in operation relative to the first shaft through an adjustable angle, and a shuttle piston (Pa) movable between a first stationary abutment defining its bottom dead-center and a second stationary abutment defining its top dead-center, the shuttle piston (Pa) being urged towards its top dead-center by resilient means, in that the portion of the non-deformable cavity that extends between the pistons (P1, P2, Pa, Ps) is filled with a constant reference volume of substantially incompressible hydraulic fluid that is defined when the valve rests against its seat, when the opening and closing pistons (P1, P2) are at their bottom dead-centers, and when the shuttle piston (Pa) is at its top dead-center, in that the opening piston (P1), the closing piston (P2), and the shuttle piston (Pa) have a common cylinder capacity and move a same volume of fluid between their bottom and top dead-centers, and in that the resilient return means of the shuttle piston (Pa) and of the valve are such that the fluid pressure needed for moving the shuttle piston (Pa) to its bottom dead-center is less than the pressure needed for opening the valve.

2. A control device according to claim 1, wherein the second shaft may be advanced in operation relative to the first shaft up to a maximum phase-shift angle, the opening and closing cams (C1, C2) each comprising a base circular arc (C11, C21) and a single lobe of profile that is constituted by a rising ramp (C12, C22) enabling the corresponding piston (P1, P2) to be moved from its bottom dead-center to its top dead-center, followed by a second circular arc (C13, C23) concentric with the base circle (C11, C21) and of greater diameter, enabling the opening and closing pistons (P1, P2) to be held stationary in their top dead-centers, followed by a descending ramp (C14, C24) enabling the opening and closing valves to be returned towards their bottom dead-centers, the central angle ($\alpha$11) of the base circular arc (C11) of the opening cam (C1) being not less than the central angle ($\alpha$22) of the rising ramp (C22) of the closing cam (C2) plus the maximum phase-shift angle, the central angle ($\alpha$21) of the base circular arc (C21) of the closing cam (C2) being not less than the central angle ($\alpha$14) of the descending ramp (C14) of the opening cam (C1) plus the maximum phase-shift angle.

3. A control device according to claim 2, wherein over the entire phase-shift range, the relative angular setting of the first and second shafts is such that the opening piston (P1) leaves its bottom dead-center under the action of the rising ramp (C12) of the opening cam (C1) after the shuttle piston (Pa) has reached its top dead-center under the action of the rising ramp (C22) of the closing cam (C2), and such that the closing piston (P2) reaches its bottom dead-center under the action of the descending ramp (C24) of the closing cam (C2) before the opening piston (P1) leaves its top dead-center under the action of the descending ramp (C14) of the opening cam (C1).

4. A control device according to claim 3, wherein the relative angular setting of the first and second shafts is defined in such a manner that, for a zero phase-shift angle between the first and second shafts, which angle corresponds to the maximum duration of valve opening, the closing piston (P2) leaves its top dead-center after the opening piston (P1) has reached its top dead-center, thereby creating an initial phase-shift range in which the valve (2) remains stationary for a certain length of time at its maximum lift between its opening and closing stages.

5. A control device according to claim 3, wherein the relative setting of the first and second shafts is defined in such a manner that, for a zero phase-shift angle between the first and second shafts, the closing piston (P2) leaves its top dead-center before the opening piston (P1) reaches its top dead-center.

6. A control device according to claim 2, wherein the maximum phase-shift angle of the closing cam (C2) relative to the opening cam (C1) is sufficient for the closing piston (P2) to leave its top dead-center before the opening piston (P1) leaves its bottom dead-center, and, at all times during the opening stage of the valve, for the volume of fluid sucked in by the closing piston (P2) from its top dead-center to be greater than the volume of fluid delivered by the opening piston (P1) from its bottom dead-center, such that the total flow delivered remains less than or equal to the common cylinder capacity, the valve remaining closed throughout the duration of the cycle and the shuttle piston (Pa) leaving and returning to its bottom dead-center so as to keep the volume of the cavity at its reference value.

7. A method of operating a control device according to claim 2, wherein at each revolution of the shafts the control device executes an opening and closing cycle of the valve, which cycle comprises successive steps starting from a rest position of the control device in which the valve rests against its seat, in which the opening and closing pistons (P1, P2) are at their bottom dead-centers, and in which the shuttle piston (Pa) is at its top dead-center, the steps comprising:

moving the closing piston (P2) from its bottom dead-center to its top dead-center by means of the rising ramp (C22) of the closing cam (C2) so as to push the shuttle piston (Pa) from its top dead-center to its bottom dead-center in order to load the control device, the opening piston (P1) remaining at its bottom dead-center by means of the base circular arc (C11) of the opening cam (C1);

moving the opening piston (P1) by means of the rising ramp (C12) of the opening cam (C1) so as to begin to open the valve, the closing piston (P2) remaining at its top dead-center by means of the second circular arc (C23) of the closing cam (C2);

adjusting the lift and the duration of the opening of the valve by shifting the phase of the closing cam (C2) relative to the opening cam (C1) so as to move the closing piston (P2) from its top dead-center by means of the descending ramp (C24) of the closing cam (C2) at any moment during the delivery stroke of the opening piston (P1) by means of the rising ramp (C12) of the opening cam (C1), before it reaches its top dead-center;

continuing to move the closing piston (P2) to its bottom dead-center by means of the descending ramp (C24) of the closing cam (C2) so as to close the valve, the opening piston (P1) remaining at its top dead-center by means of the second circular arc (C13) of the opening cam (C1); and moving the opening piston (P1) towards its bottom dead-center by means of the descending ramp (C14) of the opening cam (C1), so as to move the shuttle piston (Pa) from its bottom dead-center to its top dead-center and unload the control device.

8. A control device according to claim 1, wherein the angular duration of the opening of the valve and its lift are adjusted in operation by modifying the phase-shift angle of the second shaft while not shifting the first shaft, or vice versa, or indeed while simultaneously modifying the phase-shift angle of each of the first and second shafts relative to a crank shaft driving said first and second shafts.

9. A control device according to claim 1, wherein the profiles of the opening and closing cams (C1, C2) are such that a rest period exists during which the valve is in its closed position, the shuttle piston (Pa) is at its top dead-center, and the opening and closing pistons (P1, P2) are at their bottom dead-centers, thereby enabling leaks from the cavity to be compensated in order to recalibrate the reference volume of fluid via one-way communication with a source of fluid at a pressure that is not sufficient to move the shuttle piston (Pa).

10. A control device according to claim 1, wherein said control device controls a number N of identical valves synchronously and has a number P of mutually synchronous opening pistons (P1) that are actuated by Q identical opening cams (C1), a number R of mutually synchronous closing pistons (P2) that are actuated by S identical closing cams (C2), and at least one shuttle piston (Pa), the total volume moved by the P opening pistons (P1) between their bottom dead-centers and their top dead-centers being identical to the total volume moved by the R closing pistons (P2) between their bottom dead-centers and their top dead-centers, and also being identical to the total volume moved by the shuttle piston(s) (Pa) between its(their) bottom and top dead-centers.

11. A set of two devices according to claim 1, wherein each of said two devices actuates a single valve, the set being characterized in that the devices share a single opening cam (C1) and a single closing cam (C2) in common, so as to ensure that said valves are open and closed synchronously.

12. A device according to claim 1, wherein said device actuates at least two identical valves (2*a*, 2*b*) via a T-bar or a synchronization rocker.

13. A control device according to claim 1, wherein the body includes an additional undeformable cavity communicating with the cavity via a first cylinder and communicating with the outside via a second cylinder that is straight and of section smaller than the section of the first cylinder, being parallel thereto and facing the first cylinder, and via a third cylinder that is straight, the additional undeformable cavity communicating in unidirectional manner with a source of fluid under pressure, and in that a first piston (Ps) slides in the first cylinder, a second piston (Psa) slides in the second cylinder, the second piston (Psa) being connected to the first piston (Ps) and to a first valve of axis parallel to the first and second pistons (Ps, Psa), a third piston (Psb) slides in the third cylinder, the third piston (Psb) being connected to a second valve of axis parallel to the third piston (Psb), and in that the additional undeformable cavity contains a volume of substantially incompressible fluid that is equal to the volume of said additional undeformable cavity when the first and second valves are resting on their seats in the closed positions of said valves.

14. A control device according to claim 1, wherein the first and second shafts are coaxial.

15. A control device according to claim 1, wherein said control device includes means for retracting the first abutment for the bottom dead-center of the shuttle piston (Pa) so that said piston (Pa) can suck in the algebraic sum of the volumes of fluid delivered by the opening piston (P1) and the closing piston (P2) so as to prevent the valve from opening regardless of the phase-shift angle between the first shaft and the second shaft.

* * * * *

UNITED STATES PATENT AND TRADEMARK OFFICE

CERTIFICATE OF CORRECTION

PATENT NO. : 9,181,823 B2
APPLICATION NO. : 14/375559
DATED : November 10, 2015
INVENTOR(S) : Jean Frederic Melchior It is certified that error appears in the above-identified patent and that said Letters Patent is hereby corrected as shown below:

IN THE CLAIMS

Column 18, Claim 13, line 3, the word "non-deformable" should appear before the word "cavity,"

Signed and Sealed this
Fifth Day of April, 2016

Michelle K. Lee

Michelle K. Lee
*Director of the United States Patent and Trademark Office*